US011328657B2

(12) United States Patent
Fei et al.

(10) Patent No.: US 11,328,657 B2
(45) Date of Patent: May 10, 2022

(54) DISPLAY PANEL AND DISPLAY DEVICE

(71) Applicant: Wuhan Tianma Micro-Electronics Co., Ltd., Wuhan (CN)

(72) Inventors: Rili Fei, Wuhan (CN); Ruiyuan Zhou, Wuhan (CN); Zhiqiang Xia, Wuhan (CN); Yingjie Chen, Wuhan (CN)

(73) Assignee: Wuhan Tianma Micro-Electronics Co., Ltd., Wuhan (CN)

( * ) Notice: Subject to any disclaimer, the term of this patent is extended or adjusted under 35 U.S.C. 154(b) by 0 days.

(21) Appl. No.: 17/072,148

(22) Filed: Oct. 16, 2020

(65) Prior Publication Data

US 2021/0125546 A1 Apr. 29, 2021

(30) Foreign Application Priority Data

Oct. 28, 2019 (CN) ..... 201911033363.4

(51) Int. Cl.
*G09G 3/32* (2016.01)

(52) U.S. Cl.
CPC ..... *G09G 3/32* (2013.01); *G09G 2300/0426* (2013.01); *G09G 2310/0202* (2013.01)

(58) Field of Classification Search
CPC ..... G09G 3/2032; G09G 2300/0426; G09G 2310/0202; G09F 9/03
See application file for complete search history.

(56) References Cited

U.S. PATENT DOCUMENTS

| | | | | |
|---|---|---|---|---|
| 2019/0319212 | A1* | 10/2019 | Park | H01L 27/3276 |
| 2020/0013834 | A1* | 1/2020 | Park | H01L 51/0096 |
| 2020/0176539 | A1* | 6/2020 | Sung | H01L 27/3276 |
| 2020/0176551 | A1* | 6/2020 | Park | H01L 27/3279 |

FOREIGN PATENT DOCUMENTS

| | | | |
|---|---|---|---|
| CN | 108598115 | A | 9/2018 |
| CN | 109087938 | A | 12/2018 |
| CN | 109697953 | A | 4/2019 |
| CN | 110515247 | A | 11/2019 |

* cited by examiner

*Primary Examiner* — David Tung
(74) *Attorney, Agent, or Firm* — Anova Law Group, PLLC

(57) ABSTRACT

Display panels and display devices are provided. The display panel includes a non-display area, a display area surrounding the non-display area, and a plurality of first signal wirings arranged along a first direction. The non-display area includes a first non-display area between adjacent through-holes of the at least two through-holes, a second non-display area located between the at least two through-holes and the display area, and at least two through-holes arranged along the first direction. The plurality of first signal wirings includes a plurality of first sub-signal wirings and a plurality of first cross-lines. Each end of the first cross-line is connected to one first sub-signal wiring; a number of first cross-lines of the plurality of first cross-lines in the first non-display area is M; a number of first cross-lines of the plurality of first cross-lines in the second non-display area is N; and M is greater than N.

9 Claims, 11 Drawing Sheets

DISPLAY PANEL AND DISPLAY DEVICE

CROSS-REFERENCE TO RELATED APPLICATION

This application claims the priority of Chinese Patent Application No. 201911033363.4, filed on Oct. 28, 2019, the content of which is incorporated by reference in its entirety.

TECHNICAL FIELD

The present disclosure generally relates to the field of display technology and, more particularly, relates to a display panel and a display device.

BACKGROUND

With the development of market, consumers have become more and more demanding on the display effect of the display. The full-screen technology, through the design of ultra-narrow bezel or even bezel-less, pursues a screen ratio of 90%. Under such a design, without changing the body of the device, the display area is maximized and the display effect is even more stunning. Based on the structural design of the full screen, it is necessary to drill holes in the display area to install camera, earpiece, and sensor, etc.

For a display screen with dual cameras, due to the existence of two camera holes, when the wirings corresponding to the pixel structures of the display area extend to the through-hole area, they may continue to extend along the edge of the through-hole area. As a result, the density of the wirings in the edge of the through-hole area is increased. The excessive wiring results in a larger edge area of the through-holes and the display area of the display panel may be occupied, and the screen-to-body ratio of the display panel may be adversely affected.

Thus, there is a need to reduce the edge area of the through-hole area of the display panel. The disclosed display panels and display devices are directed to solve one or more problems set forth above and other problems in the art.

SUMMARY

One aspect of the present disclosure provides a display panel. The display panel may include a non-display area, a display area surrounding the non-display area, and a plurality of first signal wirings arranged along a first direction. The non-display area includes a first non-display area, a second non-display area and at least two through-holes; the at least two through-holes are arranged along the first direction; the first non-display area is located between two adjacent through-holes of the at least two through-holes; and the second non-display area is located between the at least two through-holes and the display area. The plurality of first signal wirings include a plurality of first sub-signal wirings and a plurality of first cross-lines; the plurality of first sub-signal wirings are disposed in the display area; and the plurality of first cross-lines are disposed in the non-display area. Each of two ends of each of the plurality of first cross-lines is connected to one first sub-signal wiring of the plurality of first sub-signal wirings. A number of first cross-lines of the plurality of first cross-lines in the first non-display area is M; a number of first cross-lines of the plurality of first cross-lines in the second non-display area is N; and M is greater than N.

Another aspect of the present disclosure provides a display device. The display device may include a functional module and a display panel. The display panel may include a non-display area, a display area surrounding the non-display area, and a plurality of first signal wirings arranged along a first direction. The non-display area includes a first non-display area, a second non-display area and at least two through-holes; the at least two through-holes are arranged along the first direction; the first non-display area is located between two adjacent through-holes of the at least two through-holes; and the second non-display area is located between the at least two through-holes and the display area. The plurality of first signal wirings include a plurality of first sub-signal wirings and a plurality of first cross-lines; the plurality of first sub-signal wirings are disposed in the display area; and the plurality of first cross-lines are disposed in the non-display area. Each of two ends of each of the plurality of first cross-lines is connected to one first sub-signal wiring of the plurality of first sub-signal wirings. A number of first cross-lines of the plurality of first cross-lines in the first non-display area is M; a number of first cross-lines of the plurality of first cross-lines in the second non-display area is N; and M is greater than N. The functional group is disposed in one or more of the at least two through-holes.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

The present disclosure will be further described in detail below in conjunction with the drawings and embodiments. It can be understood that the specific embodiments described here are only used to explain the present disclosure, but not to limit the present disclosure. In addition, it should be noted that, for ease of description, the drawings only show part of the structure related to the present disclosure, but not all of the structure.

Figure 1:
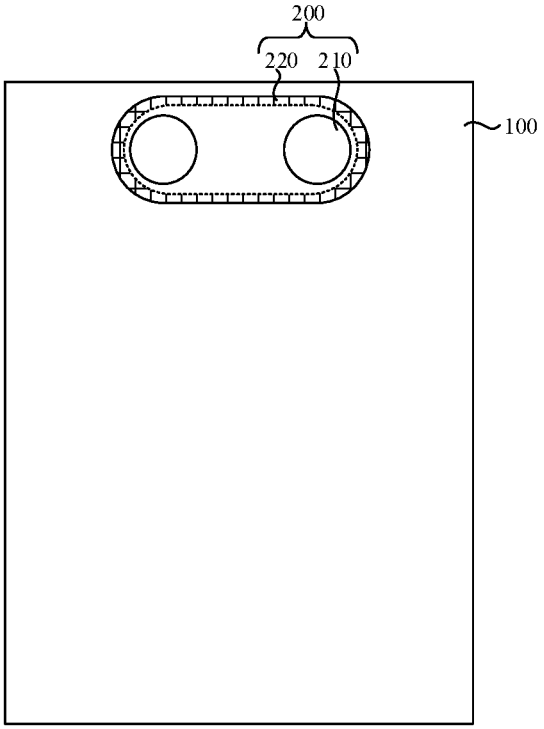
FIG. 1 illustrates a display panel having double camera holes.

FIG. 1 is a schematic structural diagram of a dual-camera display panel. As shown in FIG. 1, the dual-camera display panel includes a display area 100 and a non-display area 200. The non-display area 200 has two through-holes 210. For the pixel units of the display area 100 located at both sides of the non-display area 200, the signal wirings need to cross the non-display area 200 to achieve the communication. The layout design of the display panel extends the signal wirings along the edges of the two through-holes 210; and the wiring area 220 as shown in FIG. 1 is formed. The wiring area 200 increases the area of the non-display area at the edge of the through-holes 210, and the area occupied by the non-display area 200 is increased.

The present disclosure provides a display panel and a display device. The display panel may include a non-display area, a display area surrounding the non-display area, and a plurality of first signal wrings arranged along a first direction. The non-display area may include a first non-display area, a second non-display area and at least two through-holes. The at least two through-holes may be arranged along the first direction; the first non-display area may be located between two adjacent through-holes, and the second non-display area may be located between the through-holes and the display area. The plurality of first signal wirings may include multiple first sub-signal wirings and multiple first cross-lines. The first sub-signal wirings may be located in the display area, and the first cross-lines may be located in the non-display area. Both ends of each first cross-line may be respectively connected to a first sub-signal wiring. The number of first cross-line disposed in the first non-display area may be M, the number of first cross-lines located in the second non-display area may be N, and M may be greater than N.

The non-display area may include at least two through-holes and at least two edge areas of through-holes for wiring. The first non-display area may be the area between two adjacent through-holes, and the second non-display area may be the area surrounding the edge areas of through-holes where the wirings may be laid-out. When the at least two through-holes are arranged along the first direction, the first signal wrings arranged along the first direction may need to cross the non-display area to ensure that the pixel units at both sides of the non-display area along the direction perpendicular to the first direction to display normally under the drive of the first signal wirings. In the embodiments of the present disclosure, the first sub-signal wirings of the first signal wirings may be connected to each other in the non-display area through the first cross-lines. The first cross-lines may be disposed in the first non-display area, i.e., the area between two adjacent through-holes. The first cross-lines may also be arranged in the second non-display area, i.e., the edge areas of the through holes used for wiring. At the same time, the number M of the first cross-lines in the second non-display area may be set to be greater than the number N of the first cross-lines in the first non-display area to ensure that more of the first cross-lines may be disposed in the area between the through-holes, instead of wiring all the cross-lines in the edge areas of the through-holes.

The display panel provided by the embodiments of the present disclosure may include a non-display area, a display area surrounding the non-display area, and a plurality of first signal wirings arranged along a first direction. A first non-display area and a second non-display area and at least two through-holes may be arranged in the non-display area. The at least two through-holes may be arranged along the first direction. The first non-display area may be located between two adjacent through-holes, and the second non-display area may be located between the through-holes and the display area. At the same time, the first signal wirings may include multiple first sub-signal wirings and multiple first cross-lines. The first sub-signal wirings may be disposed in the display area; and the first cross-lines may be disposed in the non-display area. Two ends of each cross-line may be may be connected to one first sub-signal wiring, respectively. The number M of first cross-lines located in the first non-display area may be greater than the number N of first cross-lines located in the second non-display area. Such a configuration may realize to dispose more first cross-lines in the first non-display area, i.e., the area between two adjacent through-holes. The embodiments of the present disclosure may solve the problem of the increase of the area of the non-display area caused by arranging wirings in the edge areas of the through-holes in the display panel; and may ensure that more of the first cross-lines may be arranged in the area between two adjacent through-holes, instead of disposing all the cross-lines at the edge areas of the through-holes. Accordingly, the wiring area at the edge areas of the through-holes may be reduced, and the area between adjacent through-holes may be more effectively utilized. Thus, the reduction of the area of the non-display area and the optimization of display panel space utilization may be realized.

The above is the core idea of the present disclosure. The technical solutions in the embodiments of the present disclosure will be described clearly and completely in conjunction with the accompanying drawings in the embodiments of the present disclosure. Based on the embodiments of the present disclosure, all other embodiments obtained by a person of ordinary skill in the art without creative work shall fall within the protection scope of the present disclosure.

Figure 2:
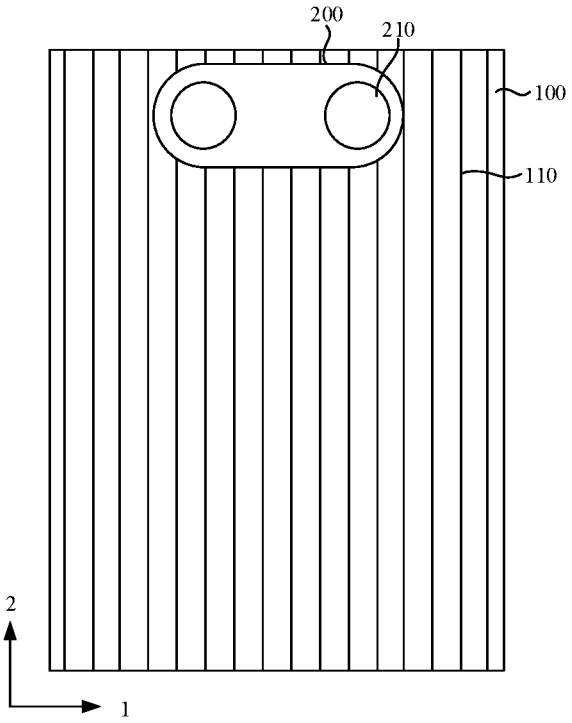
FIG. 2 illustrates an exemplary display panel consistent with various disclosed embodiments of the present disclosure.
Figure 3:
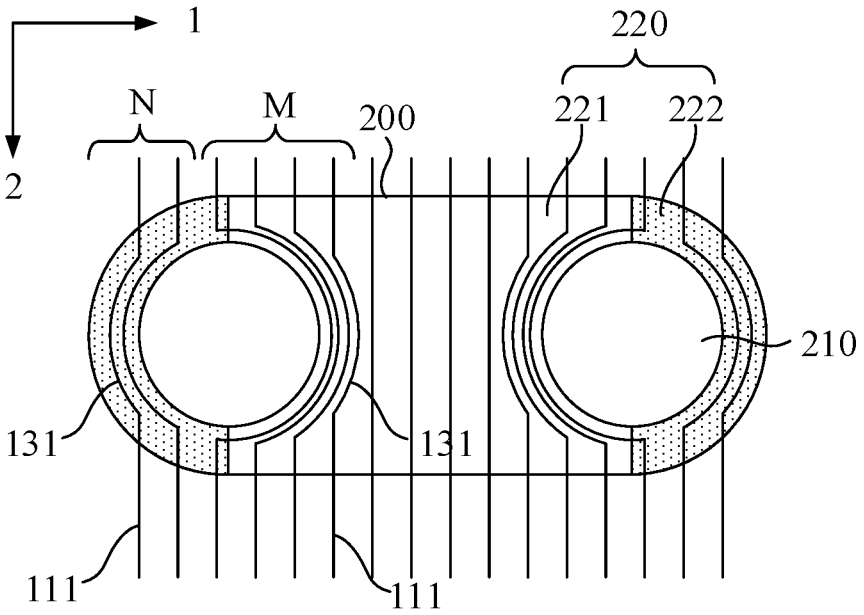
FIG. 3 illustrates a portion of the display panel in FIG. 1.

FIG. 2 is a schematic structural diagram of an exemplary display panel consistent with various disclosed embodiments of the present disclosure. FIG. 3 illustrates a portion of the display panel in FIG. 2.

As show in FIGS. 2-3, the display panel may include a non-display area 200, a display area 100 surrounding the non-display area 200, and a plurality of first signal wirings 110 arranged along a first direction 1. The non-display area 200 may include a first non-display area 221, a second non-display area 222 and at least two through-holes 210. The at least two through-holes 210 may be arranged along the first direction 1. The first non-display area 221 may be located between two adjacent through-holes 210, and the second non-display area 222 may be located between the through-holes 210 and the display area 100. The first signal wirings 110 may include a plurality of first sub-signal wirings 111 and a plurality of first cross-lines 131. The first sub-signal wirings 111 may be located in the display area 100, and the first cross-lines 131 may be located in the non-display area 200. Each end of a cross-line 131 may be connected to one first sub-signal wiring 111. The number of the first cross-lines 131 disposed in the first non-display area 221 may be M, the number of first cross-lines 131 disposed in the second non-display area 222 may be N, and M may be greater than N.

As shown in FIGS. 2-3, that the at least two through-holes 210 are arranged along the row direction of display panel may be used as an example to describe the wiring structure in the display panel. The first direction 1 may be the row direction of the display panel. The first signal wirings 110 arranged along the row direction may include data signal lines, namely, data lines, and positive power source voltage signal lines, namely, PVDD lines, etc. Therefore, the first sub-signal wirings 111 may be Data lines, or PVDD lines. In the embodiment shown in FIG. 3, taking the first sub-signal lines 111 may be the Data lines as an example, the Data lines extending along the second direction 2 may need to be connected through the non-display area 200. The first cross-lines 131 in the non-display area 200 may be selected to be disposed in the edge areas of the through-holes 210, or in the area between two adjacent through-holes 210.

As shown in FIG. 2, by setting the number M of the first cross-lines 131 in the first non-display area 221 to be greater than the number N of the first cross-lines 131 in the second non-display area 222, the wirings in the edge areas of the through-holes 210 may be reduced, and the edge areas of the through-hole 210 occupied by the wirings may be reduced. Thus, the area of the non-display area 200 may be reduced. It should be noted that in the above-mentioned embodiment, all the first cross-lines 131 may be arranged in the first non-display area 221, and no wiring may be arranged in the second non-display area 222. Under such a configuration, the area of the second non-display area 222 may be reduced as much as possible to facilitate to make full use of the non-display area, and maximize the display area.

In the following, that the first direction 1 is referred to as the row direction is used as an example to introduce other signal wirings in the display panel. In particular, different signal wirings in the display panel may transfer different signals. For data signals, different Data lines may correspond to different pixel unit columns to provide different data signals; and for different PVDD lines, the voltage signals on them may all be consistent.

Figure 4:
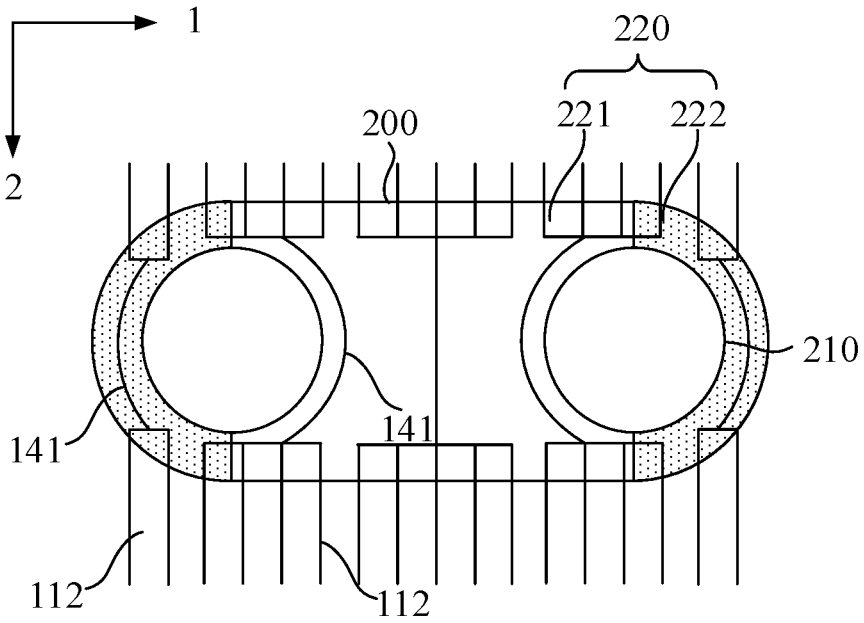
FIG. 4 illustrates a portion of another exemplary display panel consistent with various disclosed embodiments of the present disclosure.

In one embodiment of the present disclosure, for different signal wirings, the wiring mode may be different. FIG. 4 illustrates a portion of another exemplary display panel consistent with various disclosed embodiments of the present disclosure.

As shown in FIG. 4, in such a display panel, the plurality of first signal wirings 110 may further include a plurality of second sub-signal wirings 112 and a plurality of first common cross-lines 141. The second sub-signal wirings 112 may be disposed in the display area 100, and the plurality of first common cross-lines 141 may be disposed in the non-display area 200. Among the plurality of second sub-signal wirings 112, there are a preset number of second sub-signal wirings 112 having a same signal, and each end of a first common cross-line 141 may be connected to multiple second sub-signal wirings of the preset number of second sub-signal wirings 112 having the same signal.

The second sub-signal wirings 112 and the first sub-signal wirings 111 may be all arranged along the row direction. In particular, the second sub-signal wirings 112 and the first sub-signal wirings 111 may both extend along the column direction. It should be noted that, in the display panel, the first sub-signal wirings 111 and the second sub-signal wirings 112 may be disposed on a same film layer, or on different layers to avoid mutual interference between signals and prevent the aperture ratio of the pixel units from being affected by the too many signal wirings among them. The wiring structure of the display panel shown in FIG. 3 only shows the layout of the second sub-signal wirings 112. The first sub-signal wirings 111 in the display panel shown in FIG. 2 and the second sub-signal wirings 112 may be disposed in different film layers. Thus, they are not shown in FIG. 3, but it does not mean that the first sub-signal wirings 112 do not exist in the display panel shown in FIG. 4.

As shown in FIG. 4, because the same signal is transmitted on the preset number of second sub-signal wirings 112, when crossing through the non-display area 200, the same signal may be transmitted by sharing a same cross-line. In particular, the two ends of the first common cross-line 141 may be respectively connected to multiple second sub-signal wirings 112. Under such a configuration, the wirings in the non-display area 200 may be reduced as much as possible, which may be beneficial to make full use of the non-display area 200 and reduce the edge areas of the through holes 210. In one embodiment, the second sub-signal wirings 112 may be PVDD lines. Because the PVDD signals on different PVDD lines may be same, the preset number of PVDD lines here may be all PVDD lines that cross the non-display area 200. In some embodiments, the PVDD lines may be divided into a preset number of PVDD lines to share the first common cross-lines 141 according to actual conditions.

Figure 5:
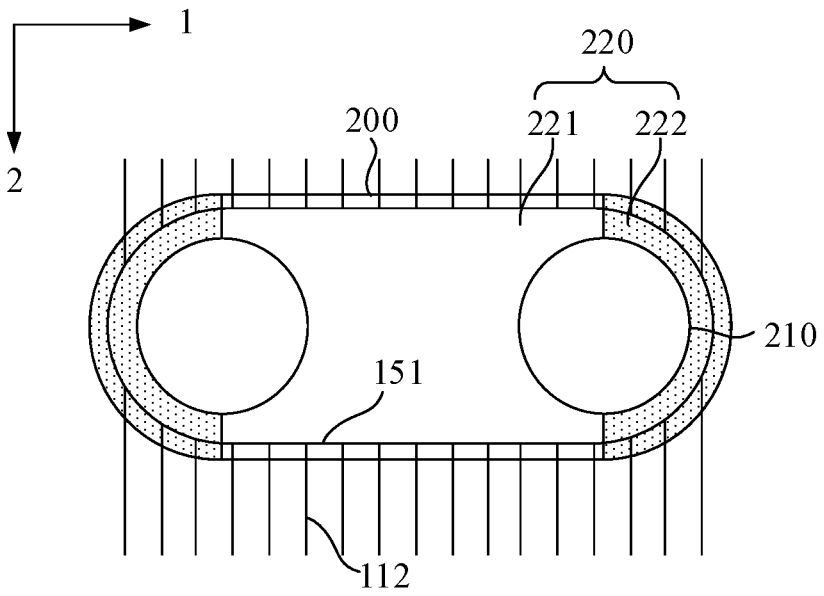
FIG. 5 illustrates a portion of another exemplary display panel consistent with various disclosed embodiments of the present disclosure.

Further, that first direction 1 is as the row direction may be used as an example to describe another layout of the second sub-signal wirings having the same signal in the first signal wirings. FIG. 5 illustrates a portion of another exemplary display panel provided by various disclosed embodiments of the present disclosure.

As shown in FIG. 5, in such a display panel, the plurality of first signal wirings may further include a plurality of second sub-signal wrings 112 and a first common surrounding line 151. The second sub-signal wirings 112 may be disposed in the display area 100, and the first common surrounding line 151 may be disposed in the non-display area 200 and may surround the non-display area 200. The signals on the plurality of second sub-signal wirings 112 may be same. The common surrounding line 151 may be connected to the plurality of second sub-signal wirings 112.

As shown in FIG. 5, by disposing the first common surrounding line 151 along the edge of the non-display area 200, different second sub-signal wirings 112 may receive the same signal, the connection of the second sub-signal wirings 112 in the non-display area 200 may be achieved.

Further, in the display panel provided by the above embodiment, in addition to the first signal wirings arranged along the first direction, the display panel may further include a plurality of second signal wirings arranged along the second direction. To ensure that the first signal wirings and the second signal wirings intersect in an insulated manner, the first signal wirings and the second signal wirings may need to be disposed in different layers. The wirings of the second signal wirings arranged along the column direction will be introduced below.

Figure 6:
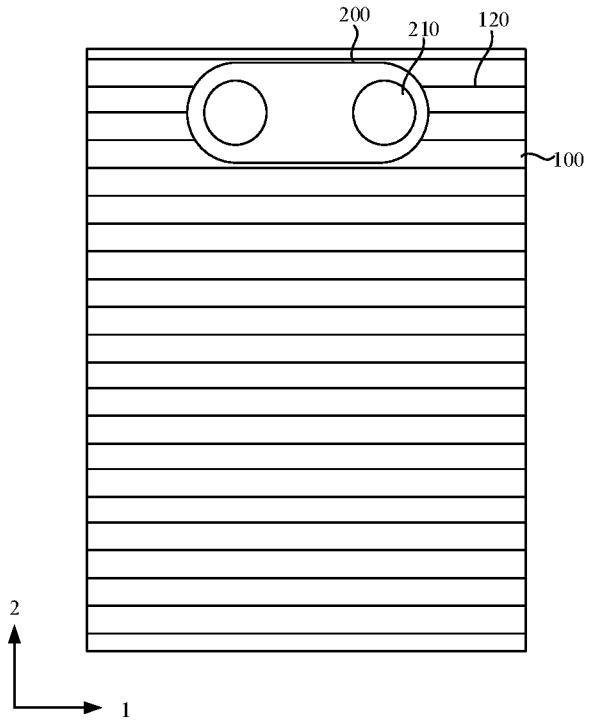
FIG. 6 illustrates another exemplary display panel consistent with various disclosed embodiments of the present disclosure.
Figure 7:
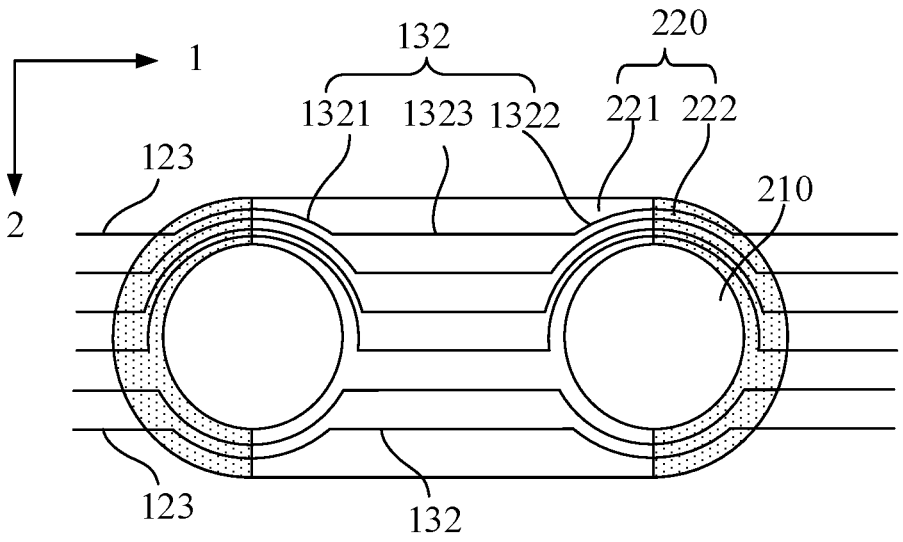
FIG. 7 illustrates a portion of the display panel in FIG. 6.

FIG. 6 illustrates another exemplary display panel consistent with various disclosed embodiments of the present disclosure. FIG. 7 illustrates a portion of the display panel in FIG. 6.

As shown in FIGS. 6-7, the display panel may further include a plurality of second signal wirings 120 arranged along a second direction 2, and the second direction 2 and the first direction 1 may intersect each other. The second signal wirings 120 may include a plurality of third sub-signal wirings 123 and a plurality of second cross-lines 132. The third sub-signal wirings 123 may be disposed in the display area 100, the second cross-lines 132 may be disposed in the non-display area 200, and both ends of the second cross-line 132 may be connected to a third sub-signal wiring 123, respectively.

The second cross-lines 132 may be configured to cause the third sub-signal wirings 123 extending laterally to cross the non-display area 200 to achieve a communication. Unlike the case that the first cross-line 131 may be be disposed in the first non-display area 221, the second cross-lines 132 may need to extend around the edge areas of the through-holes 210. In particular, it may have to be disposed in the second non-display area 222. Thus, the second cross-lines 132 may need to occupy a certain portions non-display area 200. In particular, as shown in FIG. 5, the second cross-lines 132 may be disposed to extend around one side of the edge of the non-display area 200.

Further, referring to FIG. 7, in the display panel, each second cross-line 132 may include a first surrounding line section 1321, a straight line section 1323, and a second surrounding line section 1322 that may be connected in sequence. The first surrounding line section 1321 may extend by surrounding one of the two adjacent through-holes 210. The second surrounding line section 1322 may extend by surrounding the other of the two adjacent through-holes 210, and the extending direction of the straight line section 1322 may be parallel to the central connection line direction of the two adjacent through-holes 210.

Figure 8:
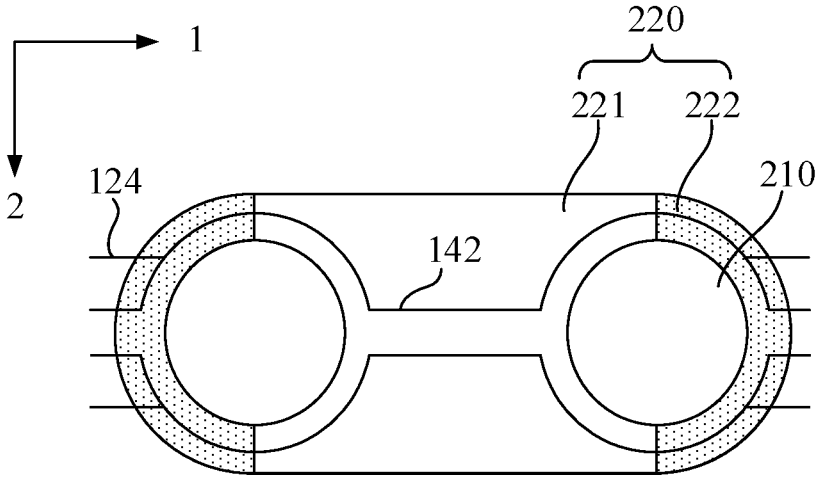
FIG. 8 illustrates a portion of another exemplary display panel consistent with various disclosed embodiments of the present disclosure.

The second signal wirings extending along the row direction may specifically include scan signal lines-scan lines, reference voltage lines-Vref lines, and light-emitting control signal lines-emit lines, etc. Among them, for the scan lines and the emit lines, generally, the scan signals and the emit signals on different scan lines and/or emit lines may be different. In some display panel circuit designs, scan lines or emit lines of pixel units in two or four adjacent rows may share the scan signal and the emit signal. For the Vref lines, the Vref signals on different signal lines may be same. Based on this, the embodiment of the present disclosure may also describe the layout of the signal lines that transmit the same signal. FIG. 8 illustrates a portion of another exemplary display panel consistent with various disclosed embodiments of the present disclosure.

As shown in FIG. 8, in the display panel, the second signal wirings may include a plurality of fourth sub-signal wirings 124 and a plurality of second common cross-lines 142. The fourth sub-signal wirings 124 may be disposed in the display area 100, and the second common cross-lines 142 may be disposed in the non-display area 200. Among the plurality of fourth sub-signal wirings 124, the signals on a preset number of fourth sub-signal wirings 124 may be same, and the two ends of each second common cross-line 142 may be respectively connected to multiple fourth sub-signal wirings of the preset number of fourth sub-signal wirings 124 having the same signal.

As shown in FIG. 8, for the case where scan lines or emit lines of several adjacent rows share scan signals or emit signals, the second common cross-lines 142 may be disposed in the non-display area 200, and the second common cross-lines 142 may be used to transmit the shared scan signals or emit signals. Taking two scan lines corresponding to two adjacent rows of pixel units sharing scan signals as an example, in particular, taking the two scan lines are the two fourth sub-signal wirings as an example, a second common cross-line 142 may be disposed correspondingly, and both ends of the second common cross line 142 may be respectively connected to the two scan lines. When the display panel performs a scanning display, the two scan lines may simultaneously input scan signals, and through the second common cross-line 142, the scan lines on both sides of the non-display area 200 may be connected.

It should be noted that the shape of the second common cross-lines 142 may be the shape extending along one side of edge of the non-display area 200, or may be composed of two surrounding line sections and a straight line section connecting the two surrounding line sections. The shape of the second common cross-line is not limited in the present disclosure. By providing the second common cross-lines 142, the wirings of the non-display area 200 for the scan lines or the emit lines may be reduced. Thus, the wiring density of the non-display area may be reduced, and a smaller non-display area may be ensured.

Figure 9:
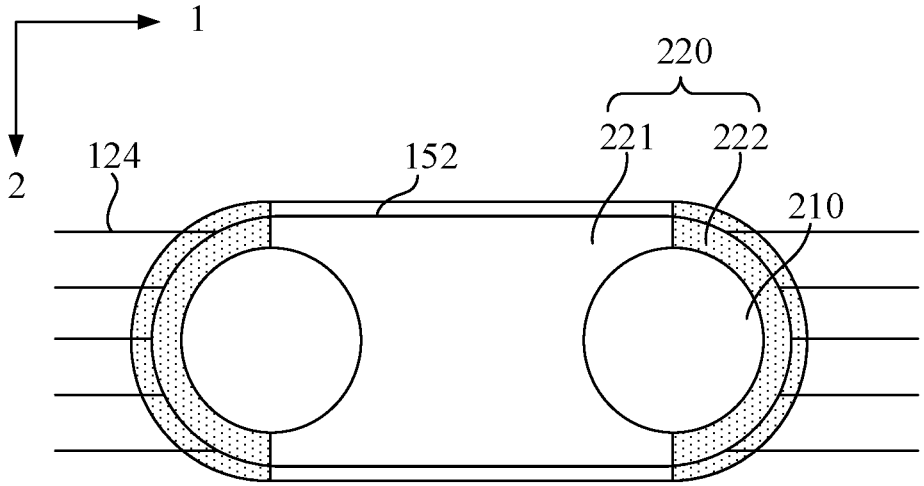
FIG. 9 illustrates another exemplary display panel consistent with various disclosed embodiments of the present disclosure.

Further, for the Vref lines in the second signal lines, since the Vref signals input from different Vref lines may be same. Similarly, the Vref lines may also be connected by sharing the surrounding lines. FIG. 9 illustrates another exemplary display panel consistent with various disclosed embodiments of the present disclosure.

As shown in FIG. 9, in such a display panel, the second signal wirings may include a plurality of fourth sub-signal wirings 124 and a second common surrounding-line 152. The fourth sub-signal wiring 124 may be disposed in the display area 100, the second common surrounding-line 152 may be disposed in the non-display area 200, and may extend by surrounding the non-display area 200. The signals on the plurality of fourth sub-signal wirings 124 may be same, and the second common surrounding line 152 may be connected to the plurality of fourth sub-signal wirings 124.

Figure 10:
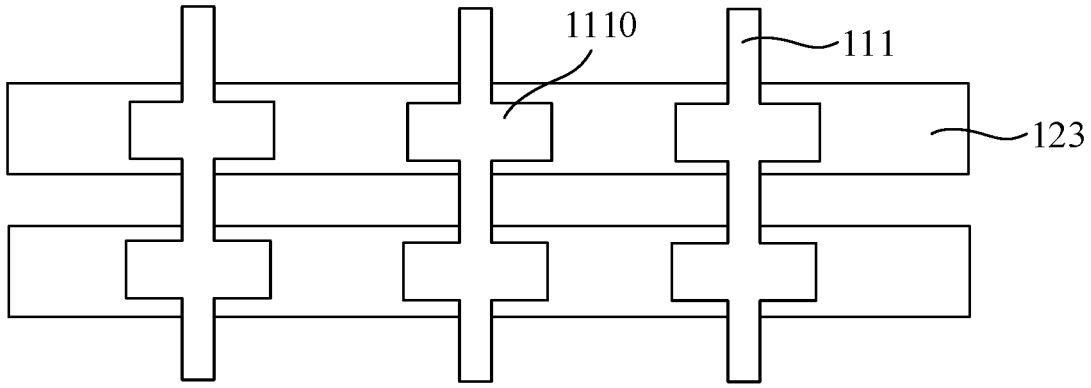
FIG. 10 illustrates a portion of another exemplary display panel consistent with various disclosed embodiments of the present disclosure.

Compared with first sub-signal lines that do not cross the non-display area 200, the first sub-signal wirings 111 at both sides of the non-display area 200 may be connected through the first cross-lines 131. The first sub-signal wirings 111 may have a small number of pixel units connected thereto, which may cause the load and capacitance of the first sub-signal wiring 111 to be inconsistent with other normal first sub-signal wirings. In particular, the Data signals transmitted on the Data lines directly affects the light-emitting brightness of each pixel of the display panel. Therefore, to ensure the uniformity of the display image, the load and capacitance of different Data lines may have to be kept consistent. To solve such a problem, the the present disclosure also provides another display panel. FIG. 10 illustrates another exemplary display panel consistent with various disclosed embodiments of the present disclosure.

As shown in FIG. 10, in such a display panel, along the thickness direction of the display panel, the first sub-signal wirings 111 and the third sub-signal wirings 123 may overlap in the first non-display area. The position where the first sub-signal wiring 111 and the third sub-signal wiring 123 overlap with each other may have a capacitance compensation pattern 1110, and the capacitance compensation pattern 1110 and the third sub-signal wiring 123 may form a compensation capacitance.

The capacitance compensation pattern 1110 may be formed at the overlapping position of the first sub-signal wiring 111 and the third sub-signal wiring 123 using a mask and using a same material as the third sub-signal wirings 123 when forming the third sub-signal wirings 123. The first sub-signal wiring 111 may be made of a metal material. Correspondingly, the capacitance compensation pattern 1110 may be a metal electrode block. The metal electrode block and the third sub-signal wiring 123 may form a capacitance to compensate the problem of insufficient capacitance of the first sub-signal wirings 111 to ensure the consistency of the signal. In particular, the number, shape, and area of the capacitance compensation patterns 1110 may be designed by those skilled in the art according to the actually measured capacitance difference.

Figure 11:
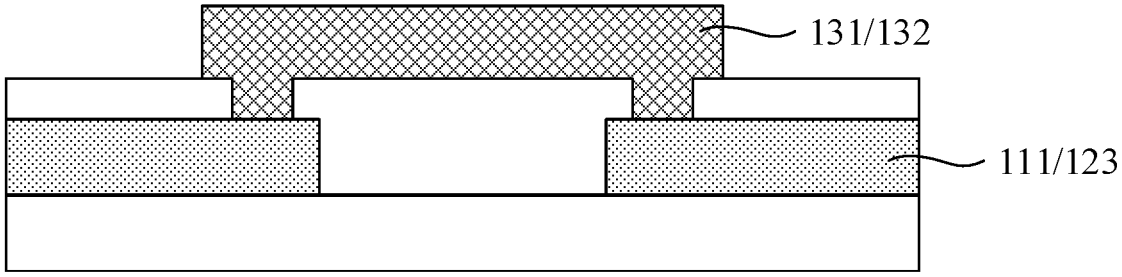
FIG. 11 illustrates a cross-sectional view of a portion of another exemplary display panel consistent with various disclosed embodiments of the present disclosure.

In addition to the aforementioned capacitance compensation, for a load compensation, the present disclosure also provides another display panel. FIG. 11 illustrates another exemplary display panel consistent with various disclosed embodiments of the present disclosure.

As shown in FIG. 11, the first cross-lines 131 and the first sub-signal wirings 111 may be disposed in different layers, and the resistivity of the first cross-lines 131 may be greater than the resistivity of the first sub-signal wirings 111. The second cross-lines 132 and the third sub-signal wirings 123 may be disposed in different layers, and the resistivity of the second cross-lines 132 may be greater than the resistivity of the third sub-signal wirings 123.

The first cross-lines 131 and the second cross-lines 132 may be made of materials with relatively large resistivity to reduce the resistance difference between the first sub-signal lines 111 and the third sub-signal lines 123 and a normal first sub-signal line and a third sub-signal line to alleviate the inconsistency of signal voltage drops. Thus, the effect to the uniformity of the display caused by the situation that the signals of the first sub-signal wirings 111 and the third sub-signal wirings 123 at different positions of the display panel are different may be avoided. It should be noted that the first cross-lines 131 and the second cross-lines 132 may be formed by the same layer and the same process as the reflective electrode layer of the display panel by using the feature of higher resistivity compared to the metal material of the reflective electrode layer. When forming the reflective electrode layer, a mask pattern may be used to prepare and form the first cross-lines 131 and the second cross-lines 132 at the same time. The first cross-lines 131 and the second cross-lines 132 may be connected to the first sub-signal wirings 111 and the third sub-signal wirings 123 through via holes, respectively.

Further, in the above-mentioned embodiment, besides the first cross-lines 131 and the second cross-lines 132 corresponding to the first sub-signal wirings 111 and the third sub-signal wirings 123 may be made of different layers of large resistivity materials. The first common cross-lines 141 corresponding to the second sub-signal wiring 112 or the second common cross-line 142 or the second common surrounding line 152 corresponding to the fourth sub-signal wiring and the first common surrounding line 151 may all be made of different layers of high resistivity materials.

In the above embodiments, at least two through-holes may be arranged along the row direction of the display panel. In particular, the first direction may be the row direction of the display panel. In the existing display panel, at least two through-holes may also be arranged along the column direction of the display panel. In particular, the first direction may also be the column direction of the display panel. In the following, the layout of the display panel will be described by taking that the first direction is the column direction of the display panel, and the at least two through-holes are arranged along the column direction as an example.

Figure 12:
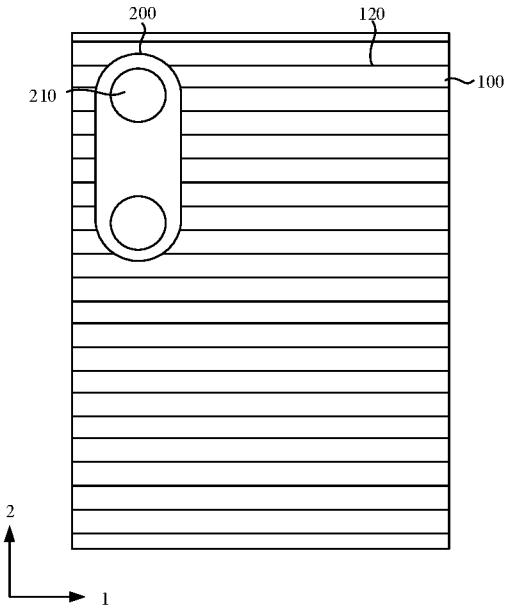
FIG. 12 illustrates another exemplary display panel consistent with various disclosed embodiments of the present disclosure.
Figure 13:
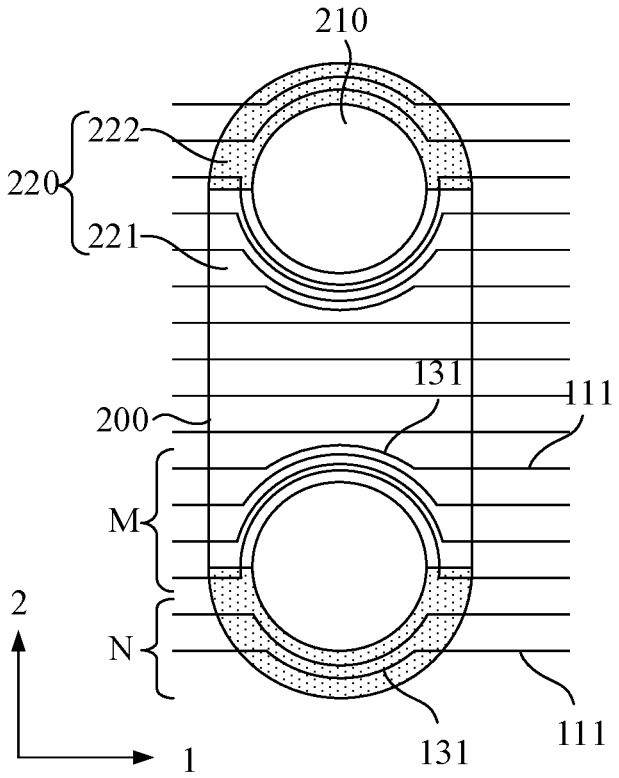
FIG. 13 illustrates a portion of the display panel in FIG. 12.

FIG. 12 illustrates another exemplary display panel consistent with various disclosed embodiments of the present disclosure. FIG. 13 illustrates a portion of the display panel shown in FIG. 12.

As shown in FIGS. 12-13, the display panel may include a non-display area 200, a display area 100 surrounding the non-display area 200, and a plurality of first signal wirings 110 arranged along a first direction 1. The non-display area 200 may include a first non-display area 221, a second non-display area 222, and at least two through-holes 210. The at least two through-holes 210 may be arranged along the first direction 1. The first non-display area 221 may be located between two adjacent through-holes 210, and the second non-display area 222 may be located between the through-holes 210 and the display area 100. The plurality of first signal wrings may include a plurality of first sub-signal wrings 111 and a plurality of first cross-lines 131. The first sub-signal wirings 111 may be located in the display area 100, and the first cross-lines 131 may be located in the non-display area 200. Both ends of the cross-line 131 may be respectively connected to a first sub-signal wiring 111. The number of the first cross-lines 131 located in the first non-display area 221 may be M, and the number of the first cross-lines 131 located in the second non-display area 222 may be N. M may be greater than N. The first direction 1 may be the column direction of the display panel. Under such a configuration, the at least two through-holes 210 may be arranged along the column direction, and the first signal wirings 110 may be arranged along the column direction. In particular, the first signal wirings 110 may extend along the row direction. The first signal wirings 110 arranged along the column direction may include scan signal lines-scan lines, reference voltage lines-Vref lines, and light-emitting control signal lines-emit lines. The first sub-signal wirings 111 may be scan lines, Vref lines, or emit lines. As shown in FIG. 10, taking the first sub-signal wirings 111 as scan lines as an example, the number M of the first cross-lines 131 in the first non-display area 221 may be greater than the number N of the first cross-lines in the second non-display area 222. Accordingly, the wirings in the edge areas of the through-holes 210 may be reduced, and the area occupied by the wirings at the edge areas of the through-holes 210 may be reduced. Thus, the area of the non-display area 200 may be reduced.

Figure 14:
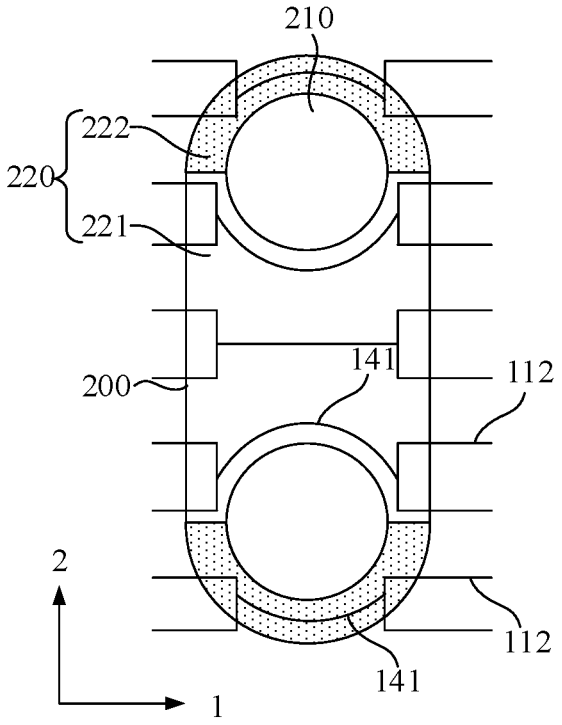
FIG. 14 illustrates a portion of another exemplary display panel consistent with various disclosed embodiments of the present disclosure.

Similarly, the first signal lines extending along the row direction may also include signal lines that convey the same signal, such as the Vref lines. Under such a configuration, a common cross-line may also be disposed to satisfy the crossing connection of multiple Vref lines in the non-display area 200. FIG. 14 illustrates a portion of another exemplary display panel consistent with various disclosed embodiments of the present disclosure.

As shown in FIG. 14, in such a display panel, the plurality of first signal wirings may further include a plurality of second sub-signal wirings 112 and a plurality of first common cross-lines 141. The second sub-signal wiring 112 may be located in the display area 100, and the first common cross-lines 141 may be disposed in the non-display area 200. Among the plurality of second sub-signal wirings 112, the signals on a preset number of second sub-signal wirings 112 may be same, and both ends of each first common cross line 141 may be respectively connected to multiple second sub-signal wirings 112 of the preset number of second sub-signal wirings 112 having the same signal.

It should be noted that the arrangement of the second sub-signal wirings as shown in FIG. 14 may also be applicable to scan lines in the presence of a common signal. In addition, the wiring structure of the display panel shown in FIG. 14 also only shows the layout of the second sub-signal wirings 112. The first sub-signal wirings 111 in the display panel shown in FIG. 13 and the second sub-signal wirings 112 may be located in different film layers. Thus, they are not shown in FIG. 14, but it does not indicate that the first sub-signal wirings 112 do not exist in the display panel shown in FIG. 14.

Figure 15:
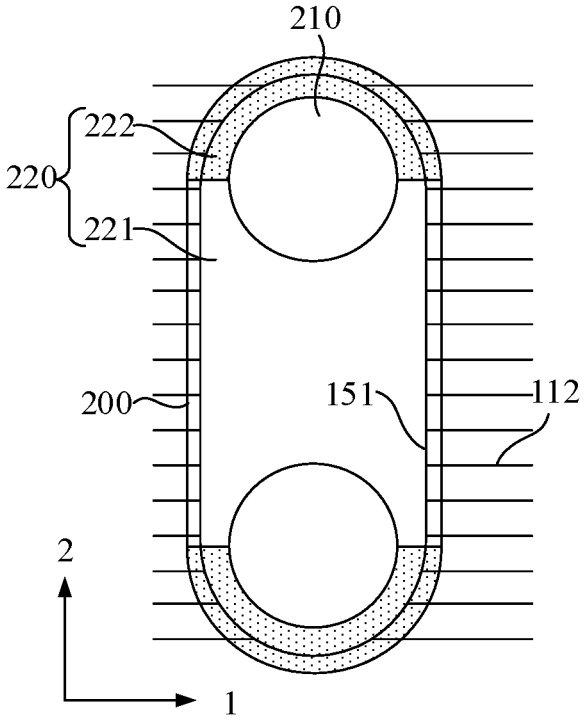
FIG. 15 illustrates another exemplary display panel consistent with various disclosed embodiments of the present disclosure.
Figure 16:
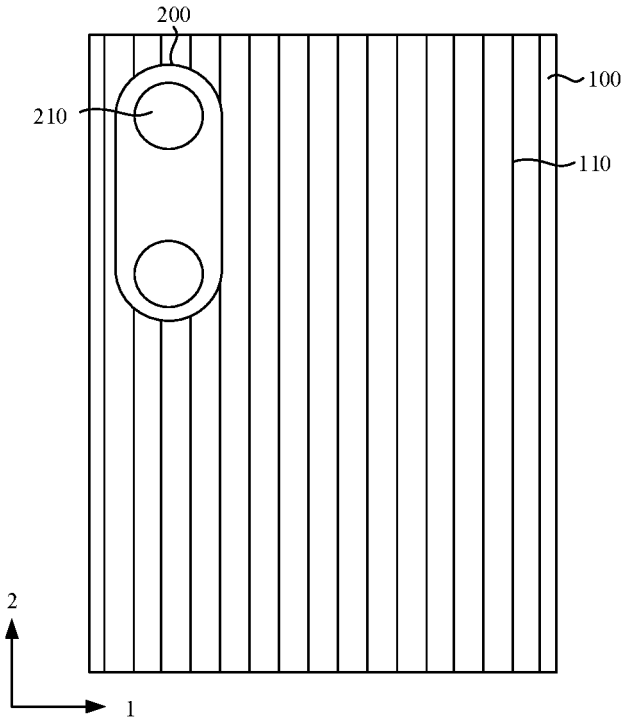
FIG. 16 illustrates a portion of the display panel in FIG. 15.

For the second sub-signal wirings having the same signal in the first signal wirings, the present disclosure also provides a wiring method. FIG. 15 illustrates another exemplary display panel consistent with various disclosed embodiments of the present disclosure. FIG. 16 illustrates a portion of the display panel shown in FIG. 15.

As shown in FIGS. 15-16, in such a display panel, the plurality of first signal wirings 110 may further include a plurality of second sub-signal wirings 112 and a first common surrounding line 151. The second sub-signal wirings 112 may be disposed in the display area 100, and the first common surrounding line 151 may be disposed in the non-display area 200 and may surround the non-display area 200. The signals on the plurality of second sub-signal wirings 112 may be same, and the first common surrounding line 151 may be electrically connected to the plurality of second sub-signal wirings 112. As shown in FIG. 16, by arranging the first common surrounding line 151 along the edge of the non-display area 200, different second sub-signal wrings 112 may also be able to receive the same signal and the connection of the second sub-signal wirings 112 in the non-display area 200 may be achieved.

The display panel described in the above embodiment may also include second signal wirings arranged along the row direction. To ensure that the first signal wrings and the second signal wirings may intersect in an insulated manner, the first signal wirings and the second signal wirings may need to be disposed in different layer. The second signal wirings 120 arranged along the row direction may include Data lines and PVDD lines. The arrangement of the second signal wirings will be described below.

Figure 17:
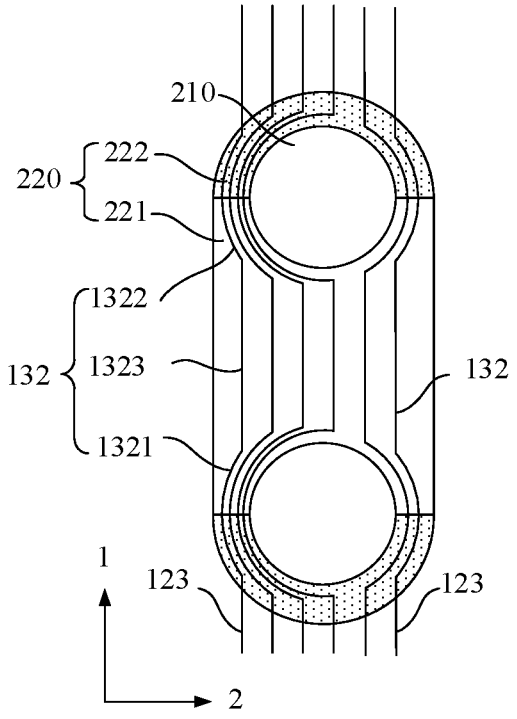
FIG. 17 illustrates a portion of another exemplary display panel consistent with various disclosed embodiments of the present disclosure.

FIG. 17 illustrates another exemplary display panel consistent with various disclosed embodiments of the present disclosure. As shown in FIG. 17, the display panel may further include a plurality of second signal wirings arranged along the second direction 2. The second direction 2 may be the row direction. The second direction 2 may intersect the first direction 1. The second signal wirings may include a plurality of third sub-signal wirings 123 and a plurality of second cross-lines 132. The third sub-signal wirings 123 may be disposed in the display area 100, and the second cross-lines 132 may be disposed in the non-display area 200, and two ends of the second cross-line 132 may be respectively connected to a third sub-signal wiring 123.

Figure 18:
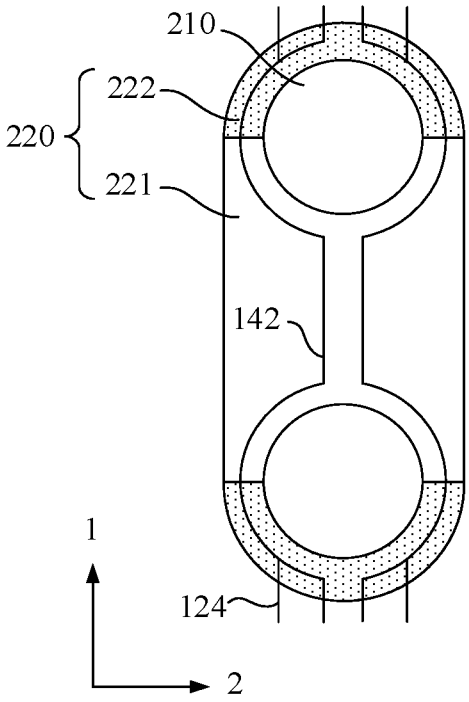
FIG. 18 illustrates a portion of another exemplary display panel consistent with various disclosed embodiments of the present disclosure.

FIG. 18 illustrates another exemplary display panel consistent with various disclosed embodiments of the present disclosure. As shown in FIG. 18, in the display panel, the second signal wirings may include a plurality of fourth sub-signal wirings 124 and a plurality of second common cross-lines 142. The fourth sub-signal wirings 124 may be disposed in the display area 100, and the second common cross-lines 142 may be disposed in the non-display area 200. Among the plurality of fourth sub-signal wirings 124, the signals on a preset number of fourth sub-signal wirings 124 may be same, and the two ends of the second common cross-line 142 may be respectively connected to multiple number of the preset number of fourth sub-signal wirings 124 with the same signal.

Figure 19:
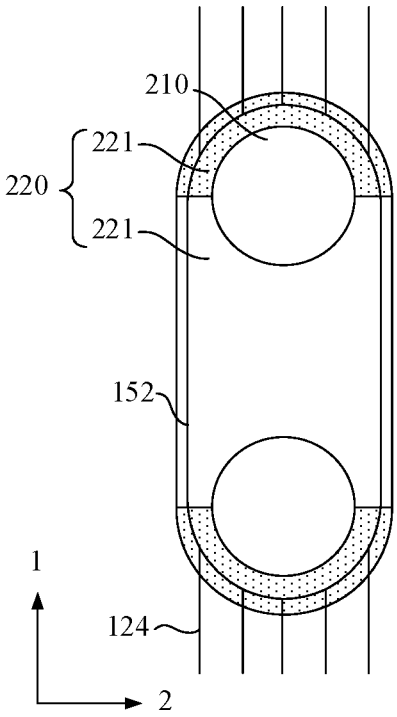
FIG. 19 illustrates a portion of another exemplary display panel consistent with various disclosed embodiments of the present disclosure.

FIG. 19 illustrates a portion of another exemplary display panel consistent with various disclosed embodiments of the present disclosure. As shown in FIG. 19, in the display panel, the second signal wirings may includes a plurality of fourth sub-signal wirings 124 and a second common surrounding wiring 152. The fourth sub-signal wirings 124 may be disposed in the display area 100; and the second common surrounding line 152 may be disposed in the non-display area 200 and extend around the non-display area 200. The signals on the plurality of fourth sub-signal traces 124 may be same and the second common surrounding wiring 152 may be connected to the plurality of fourth sub-signal wirings 124.

Figure 20:
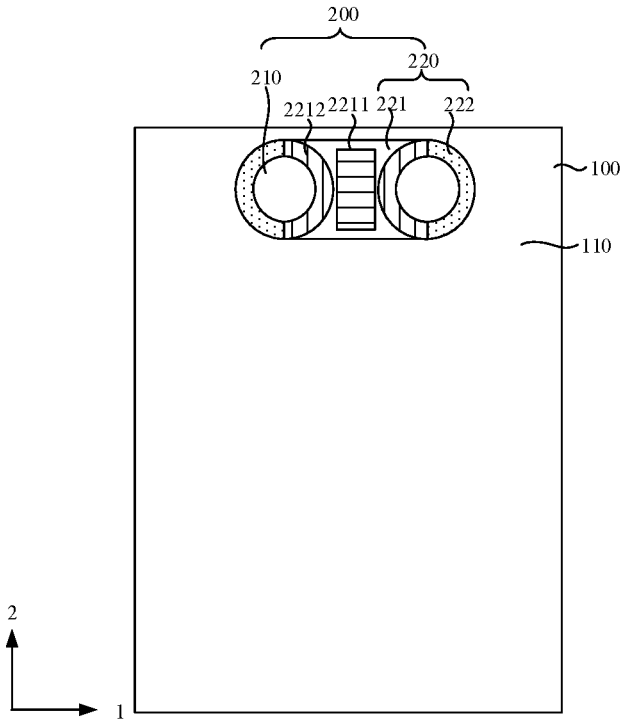
FIG. 20 illustrates another exemplary display panel consistent with various disclosed embodiments of the present disclosure.

Further, based on the layout method of the display panel in the non-display area discussed in the above embodiment, the non-display area can also be reasonably and effectively utilized. FIG. 20 illustrates another exemplary display panel consistent with various disclosed embodiments of the present disclosure.

As shown in FIG. 20, the first non-display area 221 may include a photosensitive element arrangement area 2211. The light transmittance of the photosensitive element arrangement area 2211 may be greater than the light transmittance of the display area 100. Under such a configuration, the display panel may take advantages of the higher light transmittance in the photosensitive element arrangement area 2211 to dispose the photosensitive elements, such as photosensitive modules or indicator lights, etc., to fully and effectively utilize the area of the non-display area to ensure a larger screen-to-body ratio.

Further, referring to FIG. 20, the first non-display area 221 may further include a wiring area 2212. The wiring area 2212 may include first cross-lines disposed in the first non-display area 221. The wiring area 2212 may also include second cross-lines. In the display panel shown in FIG. 20, in the non-display area 200, the first cross-lines and the second cross-lines may be disposed in the wiring area 2212 to reserve spaces for the photosensitive element arrangement area 2211 to ensure the light transmittance of the photosensitive element. This is one embodiment of the present disclosure.

Figure 21:
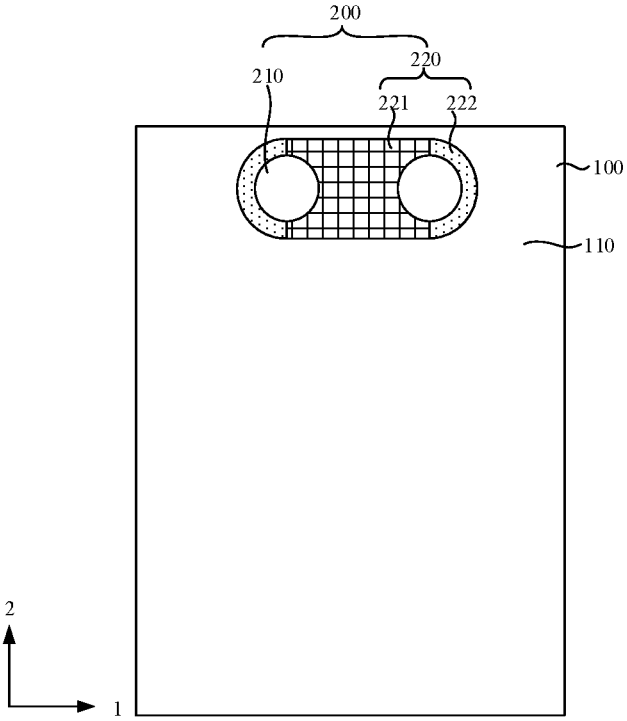
FIG. 21 illustrates another exemplary display panel consistent with various disclosed embodiments of the present disclosure.

FIG. 21 illustrates another exemplary display consistent with various disclosed embodiments of the present disclosure. As shown in FIG. 21, in the display panel, the signal wirings of the first non-display area 221 may also be arranged in a grid pattern. The density of the signal wirings distributed in the grid may be relatively small, and a certain light transmittance may be ensured on the basis of disposing the signal wiring. Comparing with the wiring area 2212 shown in FIG. 16, the wiring in the grid pattern may avoid a partial opacity, and thus may increase the area of the photosensitive element in the non-display area.

Figure 22:
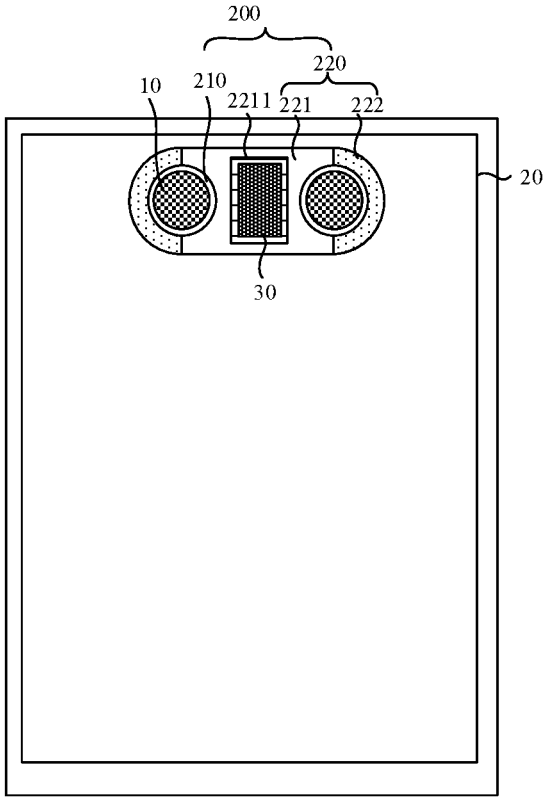
FIG. 22 illustrates an exemplary display device consistent with various disclosed embodiments of the present disclosure.

The present disclosure also provides a display device. FIG. 22 illustrates an exemplary display device consistent with various disclosed embodiments of the present disclosure.

As shown in FIG. 22, the display device may include a functional module 10 and a display panel 20. The display panel 20 may be a display panel provided by the present disclosure or other appropriate display panel. The functional module 10 may be disposed in the through-hole 210 of the display panel. The functional module 10 may generally be a camera module, or a lighting module, etc. The display device may specifically be a mobile phone, a tablet, a computer, or a smart wearable device, etc.

Further, referring to FIG. 20, the display device may also include a photosensitive element 30. A photosensitive element arrangement area 221 may be located between two adjacent through-holes 210. The photosensitive element 30 may be disposed in the photosensitive element arrangement area 2211. The light transmittance of the photosensitive element arrangement area 2211 may be greater than the light transmittance of the display area 100. In some embodiments, the photosensitive element arrangement area 2211 may be a transparent area.

Thus, in the present disclosed display panel and the display device, the display panel may include a non-display area, a display area surrounding the non-display area, and a plurality of first signal wirings arranged along the first direction. The non-display area may include a first not display area and a second non-display area and at least two through-holes. The at least two through-holes may be arranged along the first direction. The first non-display area may be located between adjacent through-holes, and the second non-display area may be located between the through-holes and the display areas. Further, the first signal wirings may include a plurality of first sub-signal wirings and a plurality of first cross-lines. The first sub-signal wirings may be located in the display area. The first through-lines may be located in the non-display area. Each of two ends of the cross-line may be respectively connected to a first sub-signal wiring. The number M of the first cross-lines located in the first non-display area may be greater than the number N of the first cross-lines located in the second non-display area. Such a configuration may realize that more of the cross-lines may be disposed in the first non-display area, i.e., the area between two adjacent through holes. The embodiments of the present disclosure may solve the problem of arranging wirings in the edge areas of the through holes in the existing display panel to increase the area of the non-display area, and ensures that more of the first cross-lines may be arranged in the area between two adjacent through-holes, and not all the first cross-lines may disposed at the edge area of the through-hole. Thus, the wiring area at the edge areas of the through-holes may be reduced, and the area between the adjacent through-holes may be more effectively utilized. Accordingly, the area of the non-display area may be reduced; and the optimization of the utilization of the space of the display panel may be improved.

It should be noted that the above are only the preferred embodiments of the present disclosure and the applied technical principles. Those skilled in the art will understand that the present disclosure is not limited to the specific embodiments described herein, and various obvious changes, readjustments, mutual combinations and substitutions can be made to those skilled in the art without departing from the protection scope of the present disclosure. Therefore, although the present disclosure has been described in more detail through the above embodiments, the present disclosure is not limited to the above embodiments, and can also include more other equivalent embodiments without departing from the concept of the present disclosure. The scope of is determined by the scope of the appended claims.

What is claimed is:

1. A display panel, comprising:

a non-display area, a display area surrounding the non-display area, and a plurality of first signal wirings arranged along a first direction, wherein:

the non-display area includes a first non-display area, a second non-display area and at least two through-holes;

the at least two through-holes are arranged along the first direction;

the first non-display area is located between two adjacent through-holes of the at least two through-holes;

the second non-display area is located between the at least two through-holes and the display area;

the plurality of first signal wirings include a plurality of first sub-signal wirings and a plurality of first cross-lines;

the plurality of first sub-signal wirings are disposed in the display area;

the plurality of first cross-lines are disposed in the non-display area;

each of two ends of each of the plurality of first cross-lines is connected to one first sub-signal wiring of the plurality of first sub-signal wirings;

a number of first cross-lines of the plurality of first cross-lines in the first non-display area is M;

a number of first cross-lines of the plurality of first cross-lines in the second non-display area is N;

M is greater than N, and a plurality of second signal wirings arranged along a second direction intersecting the first direction, wherein:

the plurality of second signal wirings includes a plurality of third sub-signal wirings and a plurality of second cross-lines;

the plurality of third sub-signal wirings are disposed in the display area;

the plurality of second cross-lines are disposed in the non-display area;

each of two ends of a second cross-line of the plurality of second cross-lines is connected to a third sub-signal wiring of the plurality of third sub-signal wirings, the plurality of first cross-lines and the plurality of first sub-signal wirings are disposed in different layers and a resistivity of the plurality of first cross-lines is greater than a resistivity of the plurality of first sub-signal wirings; and/or the plurality of second cross-lines and the plurality of third sub-signal wirings are disposed in different layers and a resistivity of the plurality of second cross-lines is greater than a resistivity of the plurality of third sub-signal wirings.

2. The display panel according to claim 1, wherein:

the first direction is a row direction of the display panel, and the plurality of first signal wirings include one or more of scan signal lines, reference voltage lines, and light-emitting control lines; or the first direction is a column direction of the display panel, and the plurality of first wirings lines include one or more of data signal lines, and positive power source voltage signal lines.

3. A display panel, comprising:

a non-display area, a display area surrounding the non-display area, and a plurality of first signal wirings arranged along a first direction, wherein:

the non-display area includes a first non-display area, a second non-display area and at least two through-holes;

the at least two through-holes are arranged along the first direction;

the first non-display area is located between two adjacent through-holes of the at least two through-holes;

the second non-display area is located between the at least two through-holes and the display area;

the plurality of first signal wirings include a plurality of first sub-signal wirings and a plurality of first cross-lines;

the plurality of first sub-signal wirings are disposed in the display area;

the plurality of first cross-lines are disposed in the non-display area;

each of two ends of each of the plurality of first cross-lines is connected to one first sub-signal wiring of the plurality of first sub-signal wirings;

a number of first cross-lines of the plurality of first cross-lines in the first non-display area is M;

a number of first cross-lines of the plurality of first cross-lines in the second non-display area is N; and M is greater than N, wherein:

a plurality of second signal wirings arranged along a second direction intersecting the first direction, the plurality of second signal wirings includes a plurality of third sub-signal wirings and a plurality of second cross-lines;

the plurality of third sub-signal wirings are disposed in the display area;

the plurality of second cross-lines are disposed in the non-display area;

each of two ends of a second cross-line of the plurality of second cross-lines is connected to a third sub-signal wiring of the plurality of third sub-signal wirings, along a thickness direction of the display panel, the plurality of first sub-signal wirings and the plurality of third sub-signal wirings overlap to each other in the first non-display area;

overlapping positions of the plurality of first sub-signal wirings and the plurality of third sub-signal wirings have capacitance compensation patterns; and the capacitance compensation patterns and the plurality of third sub-signal wirings form compensation capacitances.

4. The display panel according to claim 3, wherein:

the plurality of first signal wirings further include a plurality of second sub-signal wirings and a first common cross-line;

the plurality of second sub-signal wirings are disposed in the display area;

the first common cross-line is disposed in the non-display area;

signals on a preset number of second sub-signal wirings of the plurality of second sub-signal wirings are same; and each of two ends of the first common cross-line is connected to multiple second sub-signal wirings of the preset number of second sub-signal wirings with a same signal.

5. The display panel according to claim 3, wherein:

the plurality of first signal wirings further include a plurality of second sub-signal wirings and a first common surrounding line;

the plurality of second sub-signal wirings are disposed in the display area;

the first common surrounding line is disposed in the non-display area, and surrounds the non-display area;

signals on the plurality of second sub-signal wirings are same; and the first common surrounding line is connected to the plurality of second sub-signal wirings.

6. The display panel according to claim 3, wherein:

the plurality of second signal wirings further include a plurality of fourth sub-signal wirings and a plurality of second common cross-lines;

the plurality of fourth sub-signal wirings are disposed in the display area;

the plurality of second common cross-lines are disposed in the non-display area;

signals on a preset number of fourth sub-signal wirings of the plurality of fourth sub-signal wirings are same; and each of two ends of a second common cross-line of the plurality of second common cross-lines is connected to multiple fourth sub-signal wirings of the preset number of fourth sub-signal wirings.

7. The display panel according to claim 3, wherein:

the plurality of second signal wirings further include a plurality of fourth sub-signal wirings and a second common surrounding line;

the plurality of fourth sub-signal wirings are disposed in the display area;

the second common surrounding line is disposed in the non-display area, and extends around the non-display area;

signals on the plurality of fourth sub-signal wirings are same; and the second common surrounding line is connected to the plurality of fourth sub-signal wirings.

8. The display panel according to claim 3, wherein:

the plurality of first cross-lines and the plurality of first sub-signal wirings are disposed in different layers and a resistivity of the plurality of first cross-lines is greater than a resistivity of the plurality of first sub-signal wirings; and/or the plurality of second cross-lines and the plurality of third sub-signal wirings are disposed in different layers and a resistivity of the plurality of second cross-lines is greater than a resistivity of the plurality of third sub-signal wirings.

9. The display panel according to claim 3, wherein the first non-display area comprises:

a photosensitive element arrangement area, wherein a light transmittance of the photosensitive element arrangement area is greater than a light-transmittance of the display area.

* * * * *